US007605578B2

(12) United States Patent
Marinca

(10) Patent No.: US 7,605,578 B2
(45) Date of Patent: Oct. 20, 2009

(54) LOW NOISE BANDGAP VOLTAGE REFERENCE

(75) Inventor: Stefan Marinca, Dooradoyle (IE)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 11/890,759

(22) Filed: Aug. 7, 2007

(65) Prior Publication Data

US 2009/0027031 A1 Jan. 29, 2009

Related U.S. Application Data

(63) Continuation of application No. 11/880,760, filed on Jul. 23, 2007.

(51) Int. Cl.
*G05F 3/16* (2006.01)

(52) U.S. Cl. ..... 323/313

(58) Field of Classification Search ..... 323/313, 323/314, 907; 327/538, 539
See application file for complete search history.

(56) References Cited

U.S. PATENT DOCUMENTS 4,399,398 A 8/1983 Wittlinger
4,475,103 A 10/1984 Brokaw et al.
4,603,291 A 7/1986 Nelson
4,714,872 A 12/1987 Traa
4,808,908 A 2/1989 Lewis et al.
4,939,442 A 7/1990 Carvajal et al.
5,053,640 A 10/1991 Yum
5,119,015 A * 6/1992 Watanabe ..... 323/313
5,229,711 A 7/1993 Inoue
5,325,045 A 6/1994 Sundby
5,352,973 A * 10/1994 Audy ..... 323/313
5,424,628 A 6/1995 Nguyen
5,512,817 A 4/1996 Nagaraj
5,563,504 A 10/1996 Gilbert et al.
5,646,518 A 7/1997 Lakshmikumar et al.
5,821,807 A 10/1998 Brooks
5,828,329 A 10/1998 Burns
5,933,045 A 8/1999 Audy et al.

(Continued)

FOREIGN PATENT DOCUMENTS

EP 0510530 10/1992

(Continued)

OTHER PUBLICATIONS

PCT/EP2008/058685 International Search Report and written opinion, Oct. 1, 2008.

(Continued)

*Primary Examiner*—Adolf Berhane
(74) *Attorney, Agent, or Firm*—Wolf, Greenfield & Sacks, P.C.

(57) ABSTRACT

A bandgap voltage reference circuit that can be implemented with low noise characteristics is described. To achieve such low noise, a bandgap reference circuit is provided that includes an amplifier coupled at its inputs to first and second transistors respectively, the transistors being arranged to generate a voltage representative of the base emitter voltage differences between each of the first and second transistors across a sensing resistor. The circuit additionally provides an additional current to the sensing resistor to reduce the noise contribution into the amplifier from the first transistor. Such a circuit may be corrected for second order temperature effects by inclusion of a temperature dependent current source.

26 Claims, 5 Drawing Sheets

U.S. PATENT DOCUMENTS

| | | | | |
|---|---|---|---|---|
| 5,982,201 | A | 11/1999 | Brokaw et al. | |
| 6,002,293 | A | 12/1999 | Brokaw | |
| 6,075,354 | A | 6/2000 | Smith et al. | |
| 6,157,245 | A | 12/2000 | Rincon-Mora | |
| 6,218,822 | B1 | 4/2001 | MacQuigg | |
| 6,225,796 | B1 | 5/2001 | Nguyen | |
| 6,255,807 | B1 | 7/2001 | Doorenbos et al. | |
| 6,329,804 | B1 | 12/2001 | Mercer | |
| 6,329,868 | B1 | 12/2001 | Furman | |
| 6,356,161 | B1 | 3/2002 | Nolan et al. | |
| 6,373,330 | B1 | 4/2002 | Holloway | |
| 6,426,669 | B1 | 7/2002 | Friedman et al. | |
| 6,462,625 | B2 | 10/2002 | Kim | |
| 6,483,372 | B1 | 11/2002 | Bowers | |
| 6,489,787 | B1 | 12/2002 | McFadden | |
| 6,489,835 | B1 | 12/2002 | Yu et al. | |
| 6,501,256 | B1 | 12/2002 | Jaussi et al. | |
| 6,529,066 | B1 | 3/2003 | Guenot et al. | |
| 6,531,857 | B2 | 3/2003 | Ju | |
| 6,590,372 | B1 | 7/2003 | Wiles, Jr. | |
| 6,614,209 | B1 | 9/2003 | Gregoire, Jr. | |
| 6,642,699 | B1 | 11/2003 | Gregoire, Jr. | |
| 6,661,713 | B1 | 12/2003 | Kuo | |
| 6,664,847 | B1 | 12/2003 | Ye | |
| 6,690,228 | B1 | 2/2004 | Chen et al. | |
| 6,791,307 | B2 | 9/2004 | Harrison | |
| 6,798,286 | B2 | 9/2004 | Dauphinee et al. | |
| 6,828,847 | B1 | 12/2004 | Marinca | |
| 6,836,160 | B2 | 12/2004 | Li | |
| 6,853,238 | B1 | 2/2005 | Dempsey et al. | |
| 6,885,178 | B2 | 4/2005 | Marinca | |
| 6,891,358 | B2 | 5/2005 | Marinca | |
| 6,894,544 | B2 | 5/2005 | Gubbins | |
| 6,919,753 | B2 | 7/2005 | Wang et al. | |
| 6,930,538 | B2 | 8/2005 | Chatal | |
| 6,958,643 | B2 | 10/2005 | Rosenthal | |
| 6,992,533 | B2 | 1/2006 | Hollinger et al. | |
| 7,012,416 | B2 | 3/2006 | Marinca | |
| 7,057,444 | B2 | 6/2006 | Illegems | |
| 7,068,100 | B2 | 6/2006 | Dauphinee et al. | |
| 7,088,085 | B2 | 8/2006 | Marinca | |
| 7,091,761 | B2 | 8/2006 | Stark | |
| 7,112,948 | B2 | 9/2006 | Daly et al. | |
| 7,170,336 | B2 | 1/2007 | Hsu | |
| 7,173,407 | B2 * | 2/2007 | Marinca | 323/316 |
| 7,193,454 | B1 | 3/2007 | Marinca | |
| 7,211,993 | B2 | 5/2007 | Marinca | |
| 7,236,047 | B2 | 6/2007 | Tachibana et al. | |
| 7,260,377 | B2 | 8/2007 | Burns et al. | |
| 7,301,321 | B1 | 11/2007 | Uang et al. | |
| 7,372,244 | B2 | 5/2008 | Marinca | |
| 7,472,030 | B2 | 12/2008 | Scheuerlein | |
| 2003/0234638 | A1 | 12/2003 | Eshraghi et al. | |
| 2004/0124822 | A1 * | 7/2004 | Marinca | 323/313 |
| 2005/0073290 | A1 | 4/2005 | Marinca et al. | |
| 2005/0194957 | A1 | 9/2005 | Brokaw | |
| 2005/0237045 | A1 | 10/2005 | Lee et al. | |
| 2006/0017457 | A1 | 1/2006 | Pan et al. | |
| 2006/0038608 | A1 | 2/2006 | Ozawa | |
| 2008/0018319 | A1 | 1/2008 | Chang et al. | |
| 2008/0074172 | A1 | 3/2008 | Marinca | |
| 2008/0224759 | A1 | 9/2008 | Marinca | |
| 2008/0265860 | A1 | 10/2008 | Dempsey et al. | |

FOREIGN PATENT DOCUMENTS

| | | | |
|---|---|---|---|
| EP | 1359490 | A2 | 11/2003 |
| EP | 1359490 | A3 | 11/2003 |
| JP | 4-167010 | | 6/1992 |
| KR | 0115143 | | 12/2007 |

OTHER PUBLICATIONS

PCT/EP2008/051161 International Search Report and written opinion, May 16, 2008.

Chen, Wai-Kai, "The circuits and filters handbook", 2nd ed, CRC Press, 2003.

Cressler, John D., "Silicon Heterostructure Handbook", CRC Press-Taylor & Francis Group, 2006; 4.4-427-438.

Gray, Paul R., et al, *Analysis and Design of Analog Integrated Circuits*, Chapter 4, 4th ed., John Wiley & Sons, Inc., 2001, pp. 253-327.

PCT/EP2005/052737 International Search Report, Sep. 23, 2005.

Banba et al, "A CMOS bandgap reference circuit with Sub-1-V operation", IEEE JSSC vol. 34, No. 5, May 1999, pp. 670-674.

Brokaw, A. Paul, "A simple three-terminal IC bandgap reference", IEEE Journal of Solid-State Circuits, vol. SC-9, No. 6, Dec. 1974, pp. 388-393.

Jones, D.A., and Martin, K., "Analog Integrated Circuit Design", John Wiley & Sons, USA, 1997 (ISBN 0-47L-L4448-7, pp. 353-363).

Malcovati et al, "Curvature-compensated BiCMOS bandgap with 1-V supply voltage", IEEE JSSC, vol. 36, No. 7, Jul. 2001.

Sudha et al, "A low noise sub-bandgap voltage reference", IEEE, Proceedings of the 40th Midwest Symposium on Circuits and Systems, 1997. vol. 1, Aug. 3-6, 1997, pp. 193-196.

Widlar, Robert J., "New developments in IC voltage regulators", IEEE Journal of Solid-State Circuits, vol. SC-6, No. 1, Feb. 1971, pp. 2-7.

Jianping, Zeng, et al, "CMOS Digital Integrated temperature Sensor", IEEE, Aug. 2005, pp. 310-313.

PCT/EP2008/067402 International Search Report, Mar. 20, 2009.

* cited by examiner

LOW NOISE BANDGAP VOLTAGE REFERENCE

FIELD OF THE INVENTION

The present invention relates to bandgap voltage reference circuits and in particular to a low noise bandgap voltage reference circuit.

BACKGROUND

Bandgap voltage reference circuits are well known. Such circuits provide for a summation of two voltages having opposite variations with temperature. The first voltage corresponds to a forward biased p-n junction having a Complimentary to Absolute Temperature (CTAT) variation. A first order temperature insensitive voltage is generated by adding a CTAT voltage to a Proportional to Absolute Temperature (PTAT) voltage such that the two slopes compensate each other. The PTAT voltage is generated by amplifying the base-emitter voltage difference of two transistors operating at different collector current density.

An example of such a low noise implementation of a bandgap voltage reference is described in FIG. 1. The bandgap voltage circuit of FIG. 1 consists of three pnp bipolar transistors, QP1, QP2, QP6, four npn bipolar transistors QN1, QN2, QN6, QN7, three resistors, R1, R2, R5, an amplifier, A, and a capacitor, C1. The emitter area of the bipolar transistors are: QN1, unity emitter area; QN2, n1 times unity emitter area; QP2 unity emitter area; QP1, n2 times unity emitter area; QP6, n3 times unity emitter area; QN6, n4 times unity emitter area; QN7, n5 times unity emitter area. The role of QP6, QN6 and QN7 is to reduce the collector and base current of QP1 and QN1 and by consequence to reduce the low band noise. The low band noise of the circuit of FIG. 1 is low as all transistors, except QP1 and QN1, are diode connected and QP1 and QN1 are operating with very low base current, due to the shunting sub-circuit of QP6, QN6, and QN7.

The nominal output voltage reference of the circuit of FIG. 1 is about 2.5V corresponding to two CTAT voltages (base-emitter voltages of QN1 and QP2) plus a balanced PTAT voltage (voltage drop across R2). For lower supply voltage (less than 2.5V) a lower nominal voltage will be preferred. For low cost it is also important to implement a bandgap voltage reference based on a single type bipolar transistor, preferable npn.

SUMMARY

These and other problems are addressed by provision of a bandgap voltage reference circuit configured to provide a low noise voltage reference at an output thereof. Such a circuit may be implemented using an amplifier coupled to first and second transistors respectively, the transistors being configured to generate a voltage indicative of a base emitter voltage difference between each of the first and second transistors across a sensing resistor, this voltage difference being used to generate the required voltage reference. By providing an additional current to the sensing transistor it is possible to reduce the contribution of noise from the first transistor into the amplifier, thereby reducing the noise characteristics of the circuit.

Such a circuit may be considered as being temperature insensitive to a first order. By including a temperature dependent current source providing a current to the first transistor within the circuit, it is possible to reduce second order temperature effects from the voltage reference.

These and other features will be better understood with reference to the followings Figures which are provided to assist in an understanding of the teaching of the invention.

BRIEF DESCRIPTION OF THE DRAWINGS

The present invention will now be described with reference to the accompanying drawings in which.

DETAILED DESCRIPTION OF THE DRAWINGS

To address the problems of the prior art and other problems, the invention teaches the provision of a bandgap voltage reference circuit that can be implemented with low noise characteristics. To achieve such low noise, a bandgap reference circuit is provided that includes an amplifier coupled at its inputs to first and second transistors respectively, the transistors being arranged to generate a voltage representative of the base emitter voltage differences between each of the first and second transistors across a sensing resistor. The circuit additionally provides an additional current to the sensing resistor to reduce the noise contribution into the amplifier from the first transistor.

Circuits provided in accordance with the teaching of the invention will now be described. Such circuits are provided to assist the person skilled in the art with an understanding of the implementation of the teaching and it is not intended to limit the invention in any way except may be as deemed necessary in the light of the claims that follow. Therefore it will be understood that components or elements which are described with reference to the exemplary arrangements that follow could be replaced or interchanged with other components or elements without departing from the spirit or scope of the invention. Modifications to the circuitry described hereinafter will be apparent to the person skilled in the art and should be considered as falling within the scope of the teaching of the invention.

Figure 1:
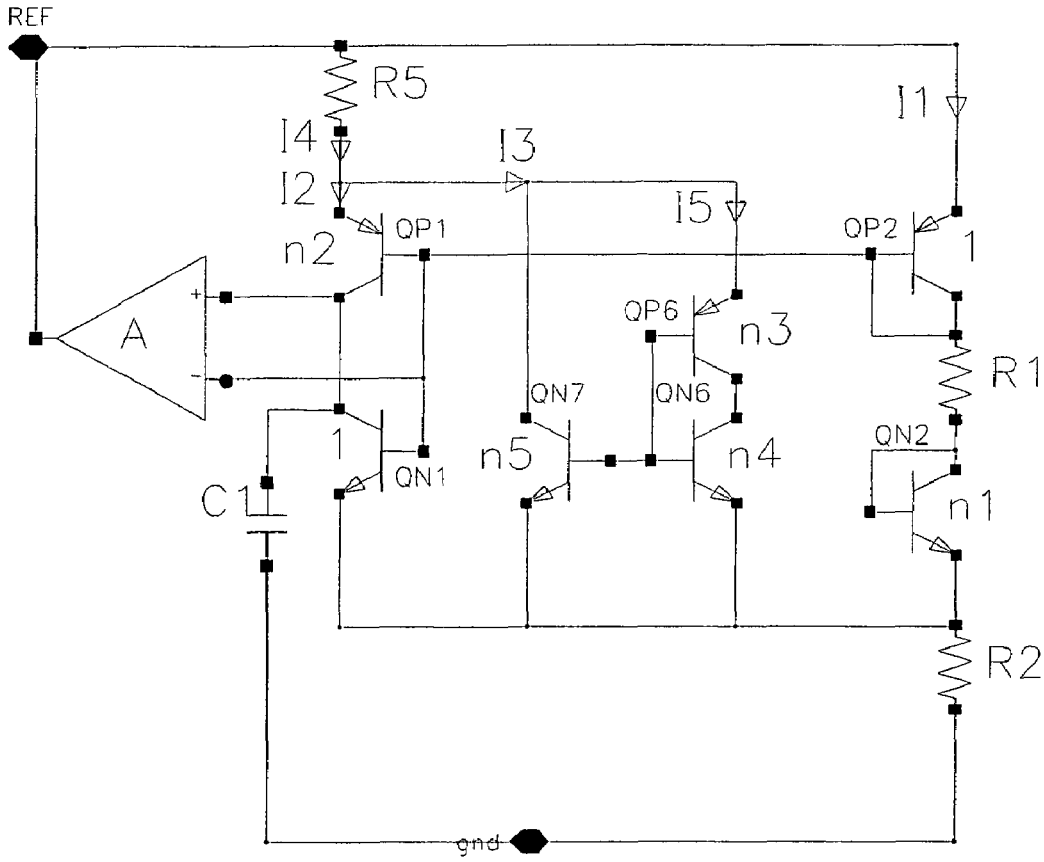
Fig.1 Prior Art
FIG. 1 is an example of a prior art low noise bandgap voltage reference circuit.
Figure 2:
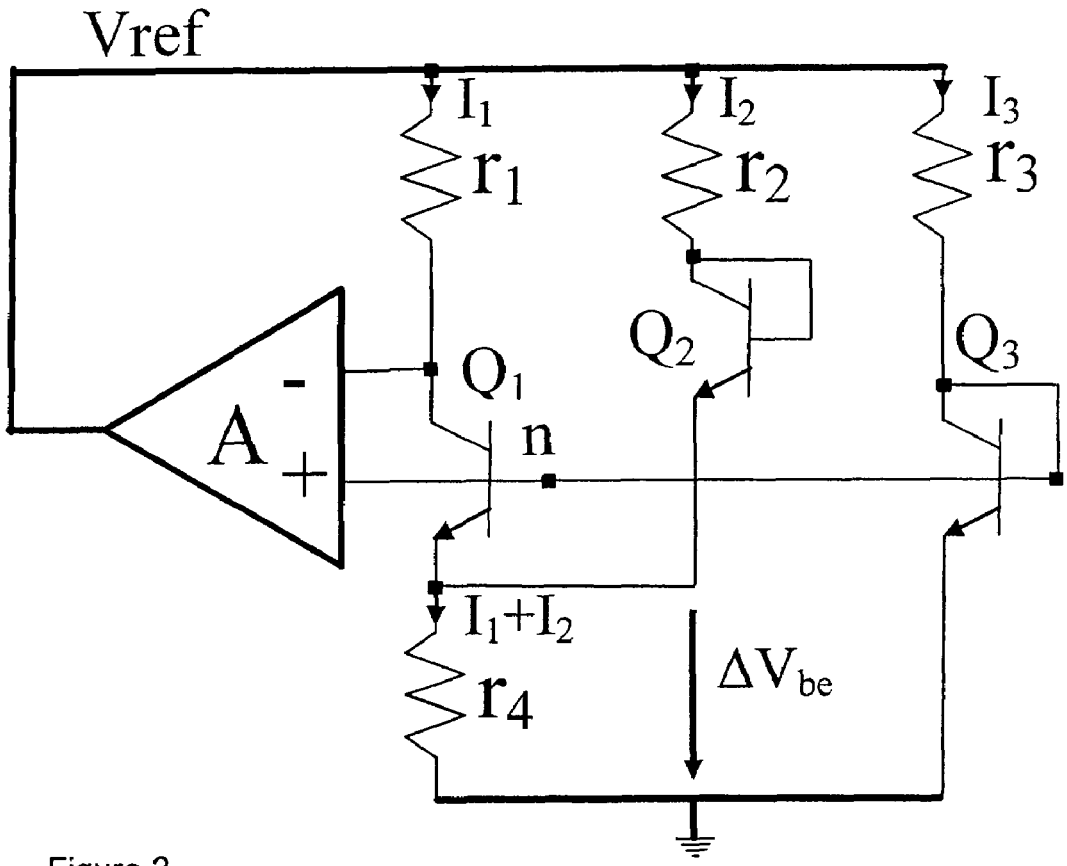
FIG. 2 is an example of a circuit provided in accordance with the teaching of the invention.

FIG. 2 shows an exemplary voltage circuit which includes three npn bipolar transistors, Q1, Q2, Q3, of which two, Q2 and Q3, are diode connected and one Q1 is virtually connected as diode connected via the amplifier A. The transistors Q1 and Q3 represent first and second transistors of the circuit respectively; Q1 is provided having an emitter area which is "n" times greater than that of Q3. In the arrangement of FIG. 2, Q1 is a combination of n parallel transistors similar to Q3. It will be understood that such an arrangement is exemplary of the type of circuitry that may be employed to generate a difference in base emitter voltages between each of Q1 and Q3. This difference in base emitter voltages is generated across the resistor r4, a sensing resistor, that is coupled to the emitter of Q1. By having such an arrangement, the base resistance of Q1 is "n" times lower compared to Q3. As base resistance is reduced the corresponding input noise to the amplifier's inverting input is also reduced.

Each of Q1 and Q3 are provided in first and second legs of the circuit and are desirably coupled in series to first r1 and second r3 resistors respectively. The value of r1 is desirably much greater than that of r3. These legs provide first $I_1$ and second $I_3$ currents respectively To provide for a further reduction in noise within the circuit, an additional current $I_2$ is provided at the sensing resistor R4. This current reduces the contribution required from the first current $I_1$, which results in less noise being provided at the input to the amplifier. This additional current or shunt current is desirably generated by providing a third leg of the circuit which includes the diode connected transistor Q2 provided in series with a resistor, $r_2$. The value of the resistor $r_2$ is desirably much less than that of $r_1$.

The provision of this shunt current serves to reduce the circuit noise as base-emitter voltage difference which is generated across the sensing resistor, r4, is provided mainly via the diode connected transistor Q2 and r2 for r1>>r2. The collector and base current of Q1 is reduced in comparison to Q3 as r1>>r3 such that a very large base-emitter voltage difference from Q3 to Q1 is established. As base-emitter voltage difference is large the gain in proportional to absolute temperature, PTAT, voltage is low and the noise is low.

The noise contribution from the amplifier A is also reduced as Q1 act as an amplifier with a gain of more than 10. As a result the offset voltage and noise due to the amplifier are accordingly reduced.

As the amplifier A keeps its two inputs at substantially the same voltage level the voltage drop across r1 and r3 are substantially the same:

$$I_1 * r_1 = I_3 * r_3 \tag{1}$$

The base-emitter voltage difference from Q3 to Q1 is reflected across the sensing resistor r4 as:

$$\Delta V_{be} = (I_1 + I_2) * r_4 = \frac{KT}{q} \ln\left(\frac{I_3}{I_1} * \frac{nI_s}{I_s}\right) = \frac{KT}{q} \ln\left(n * \frac{r_1}{r_3}\right) \tag{2}$$

As equation (2) shows this base-emitter voltage difference, $\Delta V_{be}$, is enlarged by the ratio of r1/r3. Here it will be understood that it is assumed that the base currents are negligible compared to emitter and collector currents. Also the saturation current of Q1 is "n" times larger compared to Q3.

The current via Q2 and r2 is:

$$I_2 = \frac{\Delta V_{be}}{r_4} - I_1 \tag{3}$$

Where I1 is the collector (and emitter) current of Q1.

The reference voltage is provided at the output voltage of the amplifier according to Equations (4) and (5):

$$V_{ref} = \Delta V_{be} + \left(\frac{\Delta V_{be}}{r_4} - I_1\right) * r_2 + V_{be}(Q_2) \tag{4}$$

$$V_{ref} = V_{be}(Q_3) + I_3 * r_3 = V_{be}(Q_3) + I_1 * r_1 \tag{5}$$

It can be assumed that an ideal amplifier I1 can be expressed as:

$$I_1 = \frac{V_{ref} - V_{be}(Q_3)}{r_1} \tag{6}$$

From Equations (2), (3), (4), (5) and (6) we get:

$$V_{ref} = \Delta V_{be} * \frac{r_2 + r_4}{r_1 + r_2} * \frac{r_1}{r_4} + V_{be}(Q_3) * \frac{r_2}{r_1 + r_2} + V_{be}(Q_2) * \frac{r_1}{r_1 + r_2} \tag{7}$$

As Equation (7) shows the reference voltage consists of two fractions of CTAT voltages, due to Q2 and Q3 and a corresponding PTAT voltage, due to ΔVbe. When CTAT and PTAT voltages are well balanced the reference voltage is at the first order, temperature insensitive.

Q2 and Q3 are preferable unity emitter bipolar transistors. If they operate at the same collector current then their base-emitter voltages are similar and the reference voltage is:

$$V_{ref} = \Delta V_{be} * \frac{r_2 + r_4}{r_1 + r_2} * \frac{r_1}{r_4} + V_{be}(Q_3) \tag{8}$$

Preferably r1>>r2 and the reference voltage is:

$$V_{ref} \approx \Delta V_{be} * \left(1 + \frac{r_2}{r_4}\right) + V_{be}(Q_3) \tag{9}$$

From a review of Equation (9) it will be noted that by trimming one of the two resistors, r2 or r4 it is possible to trim the reference to an optimum temperature coefficient, TC.

For applications where die area and cost are more important than noise, the reference according to FIG. 2 can be implemented with all bipolar transistors as unity emitter area. In such situations base-emitter voltage difference is established via r1/r2 and r1/r3.

It will be understood that transistor Q1 acts as a preamplifier with a gain:

$$G_1 = g_m(Q_1) * r1 \tag{10}$$

Here transistor Q1 may be considered as being provided in a common emitter configuration as the emitter voltage of transistor Q1 is mainly provided via transistor Q2 and resistor r2.

Where $$g_m(Q_1) = \frac{I_c(Q_1)}{V_T} \tag{11}$$

And:

$$r_1 = \frac{K * V_T * \ln\left(n * \frac{r_1}{r_3}\right)}{I_c(Q_1)} \tag{12}$$

Here K is gain factor for the ΔVbe voltage at which the PTAT and CTAT components are balanced in order to provide a temperature insensitive voltage reference.

Finally the gain of transistor Q1 is:

$$G_1 = \frac{I_c(Q_1)}{V_T} * \frac{K * V_T * \ln\left(n * \frac{r_1}{r_3}\right)}{I_c(Q_1)} \tag{13}$$

-continued $$= \frac{K * V_T * \ln\left(n * \frac{r_1}{r_3}\right)}{V_T}$$

$$= K * \ln\left(n * \frac{r_1}{r_3}\right)$$

As Equation (13) shows this gain is temperature insensitive. It has a typical value of about 15 to 20. Accordingly the noise and offset voltage introduced by the amplifier A are reduced by the same factor.

For those skilled in the art it is apparent that the circuit of FIG. 2 can be implemented with all PNP type bipolar transistors. The circuit can also be implemented to generate a larger reference voltage by stacking bipolar transistors. The input stage of the amplifier A can be implemented with bipolar transistors or CMOS transistors.

It will be understood that a circuit in accordance with the teaching of the present invention provides for many advantages over prior art implementations. Such advantages include:

- operable with very low noise;
- it may be implemented using a single type of bipolar transistors, NPN or PNP;
- it is operable with very low supply voltages, close to the reference voltage.

While the circuit of FIG. 2 is advantageous in that it may be implemented to provide a low noise voltage reference it does suffer somewhat in that it is temperature insensitive to a first order only. As with other non-compensated reference voltage circuits it therefore suffers from what is commonly called "curvature" or second order error. This is due to the presence of the term of TlogT in base-emitter voltage temperature dependence.

Figure 3:
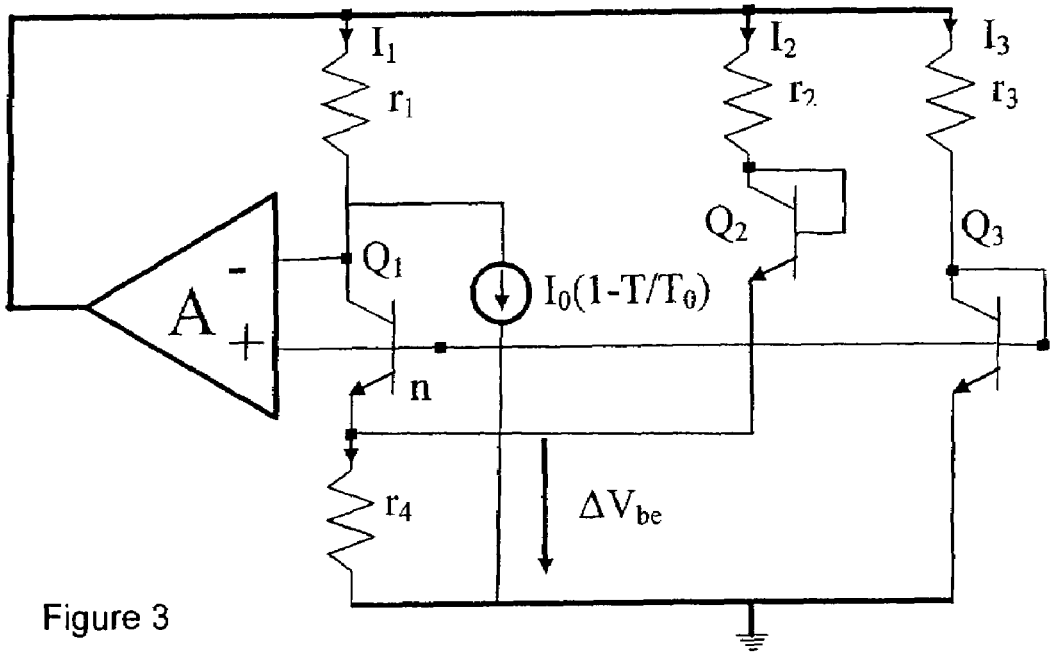
FIG. 3 is an example of a modification of the circuit of FIG. 2 to include temperature correction components.

A modification to the circuit of FIG. 2 is presented in FIG. 3 which is useful in implementation of a voltage reference which has low noise and also low Temperature Coefficient, TC. This circuit provides for the provision of a second additional current which is provided to divert at least some of current I1 away from the amplifier input so as to achieve a second order error correction.

The circuit of FIG. 3 is similar to that of FIG. 2 but includes a current source of the form of $I_0(1-T/T_0)$, where $I_0$ is its corresponding value at 0K, $T_0$ is a reference temperature, and T is the actual temperature. Such a current source provides two changes to the uncorrected voltage reference of FIG. 2: it introduces an offset voltage in base-emitter voltage difference from Q3 to Q1 and also introduces an inverse curvature voltage which compensates for the curvature error present in the voltage reference.

In a circuit such as that provided in FIG. 3, the amplifier A forces an equilibrium of voltage drops across r1 and r3:

$$I_1 * r_1 = I_3 * r_3 \tag{14}$$

It will be understood that the collector currents of Q2 and Q3 are essentially PTAT currents such that I3 can be expressed as:

$$I_3 = I_{30} * \frac{T}{T_0} \tag{15}$$

Here $I_{30}$ is Q3 collector current at reference temperature, $T_0$.

The collector current of Q1 corresponds to the current difference from I1 in r1 and offset current, $I_0(1-T/T_0)$. As a result the base-emitter voltage difference from Q3 to Q1 is:

$$\Delta V_{be} = V_{T0} * \frac{T}{T_0} * \ln\left(\frac{I_{30} * \frac{T}{T_0}}{I_{30} * \frac{T}{I_0} * \frac{r_3}{r_1} - I_0 * \left(1 - \frac{T}{T_0}\right)} * n\right) \tag{16}$$

$V_{T0}$ in Equation 16 corresponds to thermal voltage at temperature $T_0$; for $T_0$=300K it is of the order of 26 mV.

Equation 16 can be transformed as Equation 17:

$$\Delta V_{be} = V_{T0} * \frac{T}{T_0} * \ln\left(\frac{n * \frac{r_1}{r_3}}{1 - \frac{I_0}{I_{30}} * \frac{r_1}{r_3} * \frac{T_0}{T} * \left(1 - \frac{T}{T_0}\right)}\right) \tag{17}$$

For:

$$a = \frac{I_0}{I_{30}} * \frac{r_1}{r_3} \tag{18}$$

The base-emitter voltage difference is:

$$\Delta V_{be} = V_{T0} * \frac{T}{T_0} * \ln\left(\frac{n * \frac{r_1}{r_3}}{1 + a - a * \frac{T_0}{T}}\right) \tag{19}$$

The voltage difference of Equation 19 may be expanded as shown in Equation 20 to have two components; the first, $V_{T0n}$, independent of the offset current, and the second, F(T), which is a non-linear temperature dependent component:

$$\begin{aligned} \Delta V_{be} &= V_{T0} * \frac{T}{T_0} * \ln\left(n * \frac{r_1}{r_3}\right) - V_{T0} * \frac{T}{T_0} * \ln\left[1 + a - a * \frac{T_0}{T}\right] \\ &= V_{T0n} - F(T) \end{aligned} \tag{20}$$

It is known that the non-linear term in base emitter voltage of a bipolar transistor biased with PTAT current may be given by Equation 21:

$$V_{\text{non_lin-}be} = -(XTI - 1) * V_{T0} * \frac{T}{T_0} * \ln\left(\frac{T}{T_0}\right) \tag{21}$$

Here XTI which is a temperature constant, is of the order of 3 to 5.

At a temperature of approximately $T_0$, Equation 21 can be approximated as:

$$V_{\text{non_lin_be}} \approx -(XTI - 1) * V_{T0} * \frac{T}{T_0} * \left(\frac{T}{T_0} - 1\right) \tag{22}$$

The non-linear component of base-emitter voltage difference (F(T) in Equation 20) can also be approximated as:

$$V_{\text{non_lin_Dbe}} \approx V_{T0} * \frac{T}{T_0} * a * \left(\frac{T}{T_0} - 1\right) \tag{23}$$

As the base-emitter voltage difference of the circuit (i.e. voltage drop across r4) is scaled to balance the base-emitter voltage of Q2 the non-linear component of base-emitter voltage is scaled by the same factor:

$$G_{PTAT} = 1 + \frac{r_2}{r_4} \tag{24}$$

This factor is temperature independent. At temperature $T_0$, say room temperature, it is:

$$G_{PTAT} = \frac{V_{ref} - V_{be}(Q_{20})}{\Delta V_{be0}} \tag{25}$$

For typical values of $V_{ref}$=1.25V, $V_{be}(Q_{20})$=0.7V and $\Delta V_{be0}$=0.15V the gain factor is $G_{PTAT}$=3.66.

Accordingly the non-linear component in the PTAT voltage is:

$$V_{\text{non_lin_PTAT}} \approx a * G_{PTAT} * V_{T0} * \frac{T}{T_0} * \left(\frac{T}{T_0} - 1\right) \tag{26}$$

The reference voltage provided at the output of the circuit is therefore curvature corrected as is evident from an examination of Equation 27:

$$V_{non_lin_be} + V_{non_lin_PTAT} = 0 \tag{27}$$

This corresponds to:

$$(XTI - 1) * V_{T0} * \frac{T}{T_0} * \left(\frac{T}{T_0} - 1\right) = a * G_{PTAT} * V_{T0} * \frac{T}{T_0} * \left(\frac{T}{T_0} - 1\right) \tag{28}$$

From Equation 28 we get:

$$a = \frac{XTI - 1}{G_{PTAT}} \tag{29}$$

Now from Equations 18 and 29 it can be seen that the offset current amplitude, $I_0$, can be calculated as:

$$I_0 = I_{30} * \frac{r_3}{r_1} * \frac{XTI - 1}{G_{PTAT}} \tag{30}$$

It will be understood therefore that by incorporating a current of the form of $I_0(1-T/T_0)$ that second order curvature effects can be reduced. Such a current may be provided in any one of a number of different ways. One solution is to generate it as a difference of two currents one PTAT, one CTAT.

Figure 4:
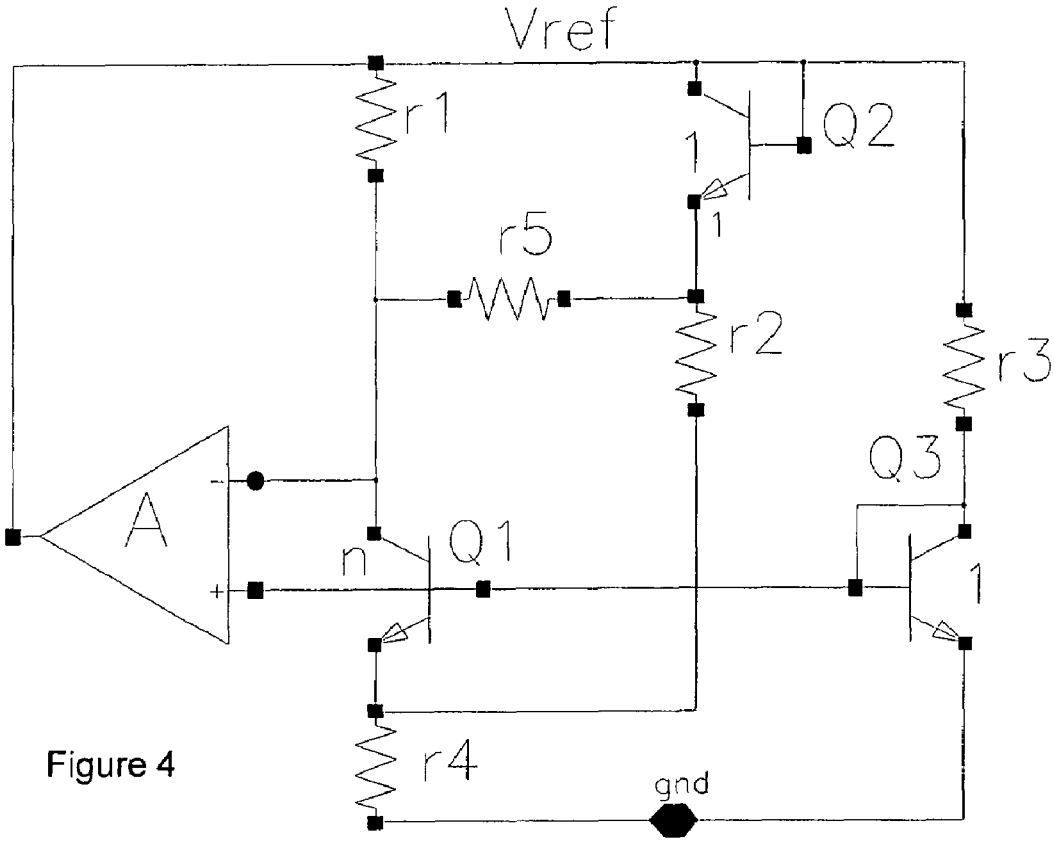
FIG. 4 is an example of the type of circuitry that may be used within the context of FIG. 3 to provide second order temperature correction.

As shown in FIG. 4, it is possible to generate a current of this form by including a load, in this case in the form of a resistor r5, between the first and third legs of the circuit. While in the circuit of FIG. 3 the order of the transistor Q2 and the resistor r2 does not matter—they are in series in the leg, in this application it is important that the resistor r5 is coupled to the sensing resistor r4 across the resistor r2. In an alternative arrangement, the resistor r5 could be provided in an additional leg coupling Q1 via r5 and an additional transistor to Vdd. In such an arrangement r5 would not have to be coupled to r2. The additional transistor of this arrangement could be provided as an extra diode connected transistor, say Q4, with its base and collector connected in a similar fashion to that of Q2 and its emitter connected to ground via the new resistor or a current source. In this case r5 will be connected at the emitter of Q4 and the effect will be similar, to that shown in FIG. 4.

From the following analysis it is evident that such an arrangement provides the current through r5 of the form of $I_0(1-T/T_0)$.

If A is assumed to be with zero offset, across r5 a voltage difference is established:

$$V_{r5} = V_{be}(Q_3) - (V_{ref} - V_{be}(Q_2)) \tag{31}$$

The reference voltage is a combination of a CTAT voltage, which is base-emitter voltage of Q2 or Q3 assumed to be the same, and a PTAT voltage, the voltage across r4 and r2. For r1>>r2 the voltage reference can be approximated as:

$$V_{ref} \approx V_{be}(Q_2) + \Delta V_{be}(T_0) * \frac{T}{T_0} * \left(1 + \frac{r_2}{r_4}\right) \tag{32}$$

From Equations 31 and 32 we get:

$$V_{r5} = V_{be}(Q_3) - \Delta V_{be}(T_0) * \frac{T}{T_0} * \left(1 + \frac{r_2}{r_4}\right) \tag{33}$$

The linear term in base-emitter voltage of Q3 is:

$$V_{be}(Q_3) = V_{G0}\left(1 - \frac{T}{T_0}\right) + V_{be}(T_0) * \frac{T}{T_0} \tag{34}$$

Here $V_{G0}$ is extrapolated bandgap voltage from temperature $T_0$ to 0K with a typical value of about 1.15V.

From Equations 31 and 34 it is evident that the voltage drop across $r_5$ is:

$$V_{r5} = V_{G0}\left(1 - \frac{T}{T_0}\right) + \left[V_{be}(T_0) - \Delta V_{be}(T_0) * \left(1 + \frac{r_2}{r_4}\right)\right] * \frac{T}{T_0} \tag{35}$$

As it is known for any bandgap type voltage reference to be close to the middle of the temperature range, $T_0$, the base-emitter voltage, $V_{be}(T_0)$, is balanced by the scaled base-emitter voltage difference, such that at $V_{r5}$ is of the desired form:

$$V_{r5} = V_{G0}\left(1 - \frac{T}{T_0}\right) \tag{36}$$

As Equation 36 shows the voltage $V_{r5}$ drops linearly from a $V_{G0}$ value at zero Kelvin to zero value at $T_0$. For $T>T_0$ this voltage is negative. In other words the current through $r_5$ is positive for $T<T_0$ and negative for $T>T_0$.

Figure 5:
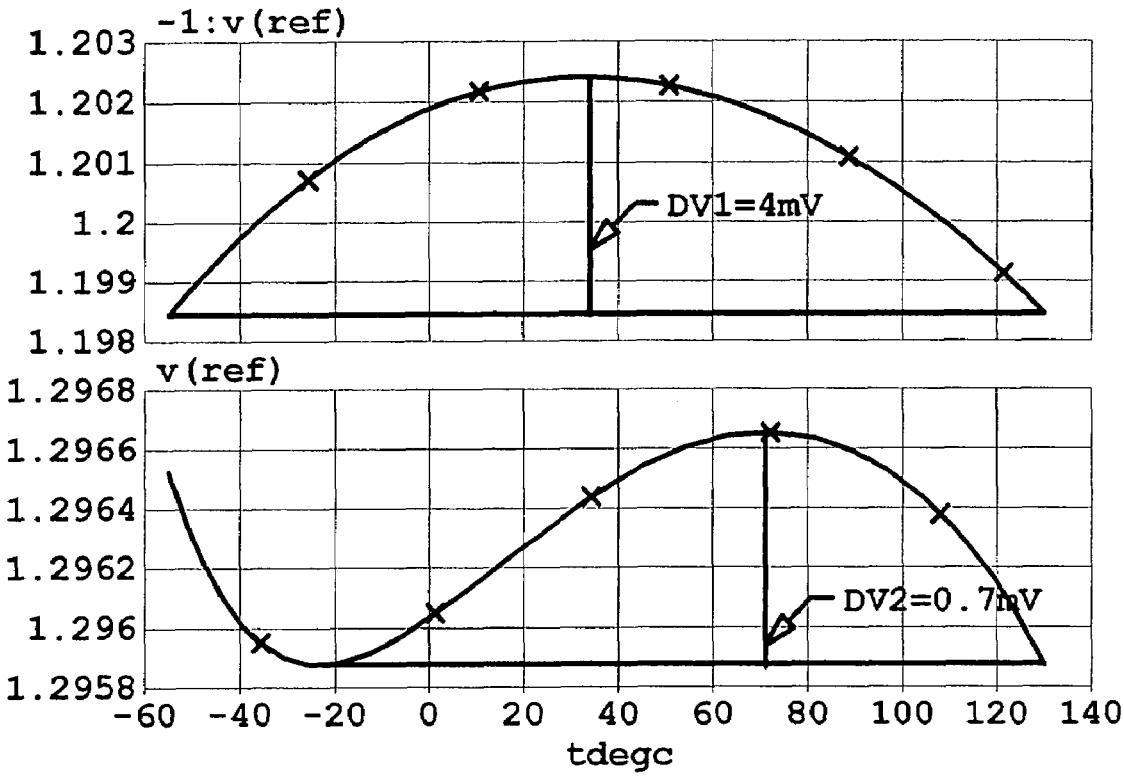
FIG. 5 is an example of simulation results showing improvements possible using a configuration according to FIG. 3.

Two voltage reference circuits according to FIGS. 2 and 3 were simulated for a temperature range from −55° C. to 130° C. to examine the effects of the curvature correction component provided by the introduction of the second shunt current. These simulated voltage references are presented in FIG. 5.

As the simulations show the voltage deviation in the specified temperature range of 185° C. for uncorrected reference voltage is 4 mV. This corresponds to a temperature coefficient, TC, of 18 ppm/° C. The reference voltage deviation for the circuit of FIG. 3 is about 0.7 mV which corresponds to a TC of 3.1 ppm/° C. As a result the corrected circuit offers about six times better temperature performance. As it was mathematically proved the voltage reference is also shifted from natural value of about 1.2V to a new value of about 1.3V.

While the inclusion of the $I_0(1-T/T_0)$ current has been described with reference to a simple arrangement where first, second and third transistors are provided in each of the first, second and third legs respectively it will be understood that the inclusion of such a current may be applied to any variation of the circuit of FIG. 2. For example as will be understood by those skilled in the art, inclusion of such a current will also provide curvature correction within the context of a modification of the circuit of FIG. 2 to include stacked transistors such as is useful in the provision of higher reference voltage values.

Advantages of the implementation of such a curvature corrected reference voltage include the very fact of its simplicity. As the desired current can be achieved by incorporation of a single resistor, curvature correction can be achieved with a minimum of area loss within the silicon. Such simplicity is also desirable in that the circuit may be implemented with low temperature coefficients.

It will be understood that the present invention has been described with specific NPN configurations of bipolar transistors but that these descriptions are of exemplary embodiments of the invention and it is not intended that the application of the invention be limited to any such illustrated configuration. It will be understood that many modifications and variations in configurations may be considered or achieved in alternative implementations without departing from the spirit and scope of the present invention. Specific components, features and values have been used to describe the circuits in detail, but it is not intended that the invention be limited in any way except as may be deemed necessary in the light of the appended claims. It will be further understood that some of the components of the circuits hereinbefore described have been with reference to their conventional signals and the internal architecture and functional description of for example an amplifier has been omitted. Such functionality will be well known to the person skilled in the art and where additional detail is required may be found in any one of a number of standard text books.

Similarly the words comprises/comprising when used in the specification are used to specify the presence of stated features, integers, steps or components but do not preclude the presence or addition of one or more additional features, integers, steps, components or groups thereof.

The invention claimed is:

1. A bandgap voltage reference circuit configured to provide a voltage reference at an output thereof, the circuit including an amplifier coupled to first and second transistors respectively, the amplifier having inverting and non-inverting inputs, the transistors being configured to generate a voltage indicative of a base-emitter voltage difference between each of the first and second transistors across a sensing resistor, wherein the base of the first transistor is coupled to the non-inverting input of the amplifier and the collector of the first transistor is coupled to the inverting input of the amplifier, the second transistor in a diode-configuration, and the circuit provides an additional current to the sensing resistor from a diode-connected third transistor, to reduce the contribution of noise from the first transistor into the amplifier.

2. The circuit of claim 1 wherein each of the first and second transistors are provided in first and second legs of the circuit respectively, the first and second legs including first and second resistors respectively.

3. The circuit of claim 2 wherein the value of the first resistor is much greater than that of the second resistor.

4. The circuit of claim 1 wherein the second transistor is operable at a higher current density than that of the first transistor.

5. The circuit of claim 1 wherein the third leg includes a third resistor of the circuit, the third resistor being provided in series with the diode-connected transistor.

6. The circuit of claim 5 wherein the value of the third resistor is much less than that of the first resistor.

7. The circuit of claim 1 wherein the second transistor is provided in a diode configuration.

8. The circuit of claim 1 wherein the provision of the additional current provides for a reduction in the base collector current of the first transistor relative to the second transistor, so as to effect generation of a large base-emitter voltage difference between the two with a resultant reduction in the gain of the generated difference in base-emitter voltages.

9. The circuit of claim 1 wherein the second and third transistors are provided as unity emitter bipolar transistors, operable at substantially the same collector current.

10. The circuit of claim 9 wherein each of the first, second and third transistors are operable with unity emitter area.

11. The circuit of claim 10 wherein a base emitter voltage difference is generated by scaling the first and third resistors.

12. The circuit of claim 5 wherein the reference voltage may be trimmed to an optimum temperature coefficient by effecting a trimming of at least one of the third and sensing resistor.

13. The circuit of claim 5 wherein the first, second and third transistors are provided as npn transistors.

14. The circuit of claim 5 wherein each of the first, second and third legs includes stacked bipolar transistors.

15. The circuit of claim 1 wherein the additional current is a first additional current, the circuit including a second additional current coupled to the sensing resistor, the second additional current being of the form $I_0(1-T/T_0)$, and providing for a correction of second-order temperature effects in the output reference.

16. The circuit of claim 15 wherein the second additional current is provided by inclusion of a load coupled between the first transistor and the first additional current.

17. The circuit of claim 5 including a load resistor coupled between the first and third legs of the circuit.

18. The circuit of claim 17 wherein the load resistor is coupled to the first leg between the first resistor and first transistor and is coupled to the second leg between the third transistor and the third resistor.

19. The circuit of claim 18 wherein each of the first, load, second and sensing resistors are in series with one another.

20. A curvature corrected bandgap voltage reference configured to provide a second order corrected voltage reference at an output thereof, the circuit including an amplifier coupled to first and second transistors respectively, the amplifier having inverting and non-inverting inputs, the transistors being configured to generate a voltage indicative of a base-emitter voltage difference between each of the first and second transistors across a sensing resistor, wherein the base of first transistor is coupled to the non-inverting input of the amplifier and the collector of the first transistor is coupled to the inverting input of the amplifier, the second transistor is in a diode configuration, and the circuit provides an additional current from a third, diode-connected transistor to the sensing resistor to reduce the contribution of noise from the first transistor into the amplifier, the circuit additionally including a temperature-dependent current source providing a current to the first transistor to reduce second-order temperature effects from the voltage reference.

21. The circuit of claim 20 wherein the temperature dependent current is of the form $I_0(1-T/T_0)$.

22. The circuit of claim 20 wherein the first and second transistors are provided in first and second legs of the circuit respectively, and the third transistor is provided in a third leg of the circuit.

23. The circuit of claim 22 wherein the third leg includes a third resistor of the circuit, the third resistor being provided in series with the diode-connected third transistor.

24. The circuit of claim 23 wherein the temperature dependent current is generated by coupling a resistor between the first and third legs of the circuit.

25. The circuit of claim 24 wherein the resistor is coupled to the third leg at a node provided between each of the third resistor and the diode-connected third transistor.

26. The circuit of claim 25 wherein a path is defined from the resistor coupling the first and third legs via the third resistor to the sensing resistor.

* * * * *